US008066582B1

(12) United States Patent
Hauser

(10) Patent No.: US 8,066,582 B1
(45) Date of Patent: Nov. 29, 2011

(54) SYSTEM AND DEVICE FOR GOLF PUTTING PRACTICE

(75) Inventor: Stephen G. Hauser, Tarzana, CA (US)

(73) Assignee: Frogger, LLC, San Mateo, CA (US)

( * ) Notice: Subject to any disclaimer, the term of this patent is extended or adjusted under 35 U.S.C. 154(b) by 0 days.

(21) Appl. No.: 13/183,283

(22) Filed: Jul. 14, 2011

(51) Int. Cl.
*A63B 69/36* (2006.01)

(52) U.S. Cl. ..... 473/257; 473/282

(58) Field of Classification Search ..... 473/218, 473/219, 257, 258, 261, 264, 265, 266, 282
See application file for complete search history.

(56) References Cited

U.S. PATENT DOCUMENTS 4,397,112 A * 8/1983 York ..... 42/94
5,492,230 A * 2/1996 Horton ..... 211/70.2
6,283,875 B1 * 9/2001 Jones ..... 473/282
7,727,082 B2 * 6/2010 Larsen ..... 473/257
7,771,287 B2 * 8/2010 Staszak ..... 473/282
2009/0042662 A1 * 2/2009 Staszak ..... 473/282

* cited by examiner

*Primary Examiner* — Nini Legesse
(74) *Attorney, Agent, or Firm* — Charter IP LLC; Matthew J. Lattig

(57) ABSTRACT

A system and device for golf putting practice, in which the device includes a first leg, a slider element attached to the first leg for grasping a shaft, and a shorter second leg pivotable to the first leg. The second leg is released and squeezed against the first to expose an opening in the slider element to receive the shaft therein, the second leg then released to pivot outward, causing the slider element to move down relative to the upper end of the first leg, closing down on the opening and seating the shaft. A second support device is installed in spaced relation on the shaft to achieve the level horizontal position of the shaft as a guide for a golfer practicing putting strokes with a golf putter.

15 Claims, 11 Drawing Sheets

SYSTEM AND DEVICE FOR GOLF PUTTING PRACTICE

BACKGROUND

1. Field

Example embodiments in general relate to a system and device for golf putting practice.

2. Related Art

Putting problems are typically caused by a putter's blade not hitting through the ball on a square path. This may be caused during the putting stroke by the blade not traveling back and through on a square putting line. In other words, a proper arc pendulum is not correctly obtained so as to consistently strike the ball squarely and send it upon the desired path. Frequently, golfers use too long of a stroke, which can also create problems. Other factors leading to improper or poor putting may include improper eye position over the ball and inadequate feet and shoulder alignment. Thus, it is desirable to find a perfect pendulum arc from backswing to follow through in the putting stroke.

There has been numerous practice putting aids designed to help ensure the golfer maintains a straight line so as to realize this pendulum arc in the putting stroke. One device includes a guide member spaced from the ground for sliding contact with the back side of a putter shaft. Another device comprises a sighting member and a shaft guide to assist in aligning and stroking a golf putt. Yet another device includes a foot mat for the golfer to stand on, thereby enabling his weight to steady the position of an accompanying guide bar on the mat during use of the device.

Still other training aids include box or track-like structures which sit on a putting or ground surface and include boundaries, clips or sightlines to guide the putting stroke or limit stroke length for a putt of any distance. Yet other training aids include extensions attached to the putter, which the golfer aligns with the desired direction of travel of the golf ball. Many of the currently popular putting training aids come into contact with the heel of the putter in a "one size training aide arc fits all" scenario. These aids may not obtain the correct pendulum arc for every sized golfer. Moreover, many putting aids are bulky and are impractical for use while the golfer is playing a round of golf and desires to get in a few practice put swings before approaching the green or awaiting his turn to putt on the green.

SUMMARY

An example embodiment is directed to a system for golf putting practice. The system includes an elongate, straight shaft, and a pair of shaft support devices configured for attachment to the shaft in spaced relation so as to hold the shaft in a level horizontal position above the ground. Each shaft support device includes an elongate main support having an upper end and lower end, a top slider slidably attached to the upper end, the top slider having a crescent-shaped opening on a top, side surface that is configured to grasp the shaft, an elongate angled leg shorter relative to the main support and having its upper end attached to an approximate midpoint of the main support, the angled leg pivotable at its attachment point to the main support and biased under spring pressure, and a loop hook for securing the angled leg alongside the main support. The loop hook is unhooked and the angled leg is released then squeezed against the main support to expose the crescent-shaped opening to attach the shaft support device to the shaft. The angled leg is then released to pivot outward under spring action, causing the top slider to move down relative to the upper end of the main support, the main support upper end seating against the shaft, the spaced-apart lower ends of the angled leg and main support forming legs of the shaft support device.

Another example embodiment is directed to a support device configured for attachment to a golf club shaft to hold the shaft in a level horizontal position above the ground for use as a guide in putting practice. The device includes a first leg having an upper end and lower end, a slider element slidably attached to the upper end and configured to grasp the shaft, a second leg shorter relative to the first leg and having its upper end attached to an approximate midpoint of the first leg, the second leg pivotable at its attachment point to the first leg and biased under spring pressure, and a loop hook for securing the second leg alongside the first leg. The loop hook is unhooked and the second leg is released then squeezed against the first leg to expose an opening in the slider element configured to receive the shaft therein, the second leg then released to pivot outward under spring action, causing the slider element to move down relative to the upper end of the first leg, closing down on the opening and seating the shaft within the opening against the first leg upper end. A second support device is installed in spaced relation on the shaft to achieve the level horizontal position of the shaft as a guide for a golfer practicing putting strokes with a golf putter.

Another example embodiment is directed to a pair of devices configured for attachment to a shaft to hold the shaft in a level horizontal position above the ground for use as a guide in putting practice, each device of the pair includes a first leg, a slider element attached to the first leg for grasping the shaft, and a shorter second leg pivotable to and from the first leg. The second leg is squeezed against the first to expose an opening in the slider element to receive the shaft therein, the second leg then released to pivot outward, causing the slider element to move down relative to an upper end of the first leg, closing down on the opening and seating the shaft. Each device installed in spaced relation on the shaft to achieve the level horizontal position of the shaft as a guide for a golfer practicing putting strokes with a golf putter.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

As to be described in detail hereafter, the example embodiments are directed to a system and device(s) for golf putting practice which generally support an elongate shaft above the ground so that the shaft may be used as a guide for putting practice. The example system and device(s) as to be described in more detail hereafter are designed to guide a putter shaft along a straight line to create a perfect pendulum golf putting swing with either a straight back and through or arc, depending upon the angle/degree of the putter at address, so as to create a consistent and natural putting stoke to come into contact with a golf ball.

The singular term "shaft" as used in the context of the example system and device(s) can represent the shaft of a golf club and/or an elongate, cylindrical line up stick that a golfer may carry in their golf bag, for example.

Figure 1:
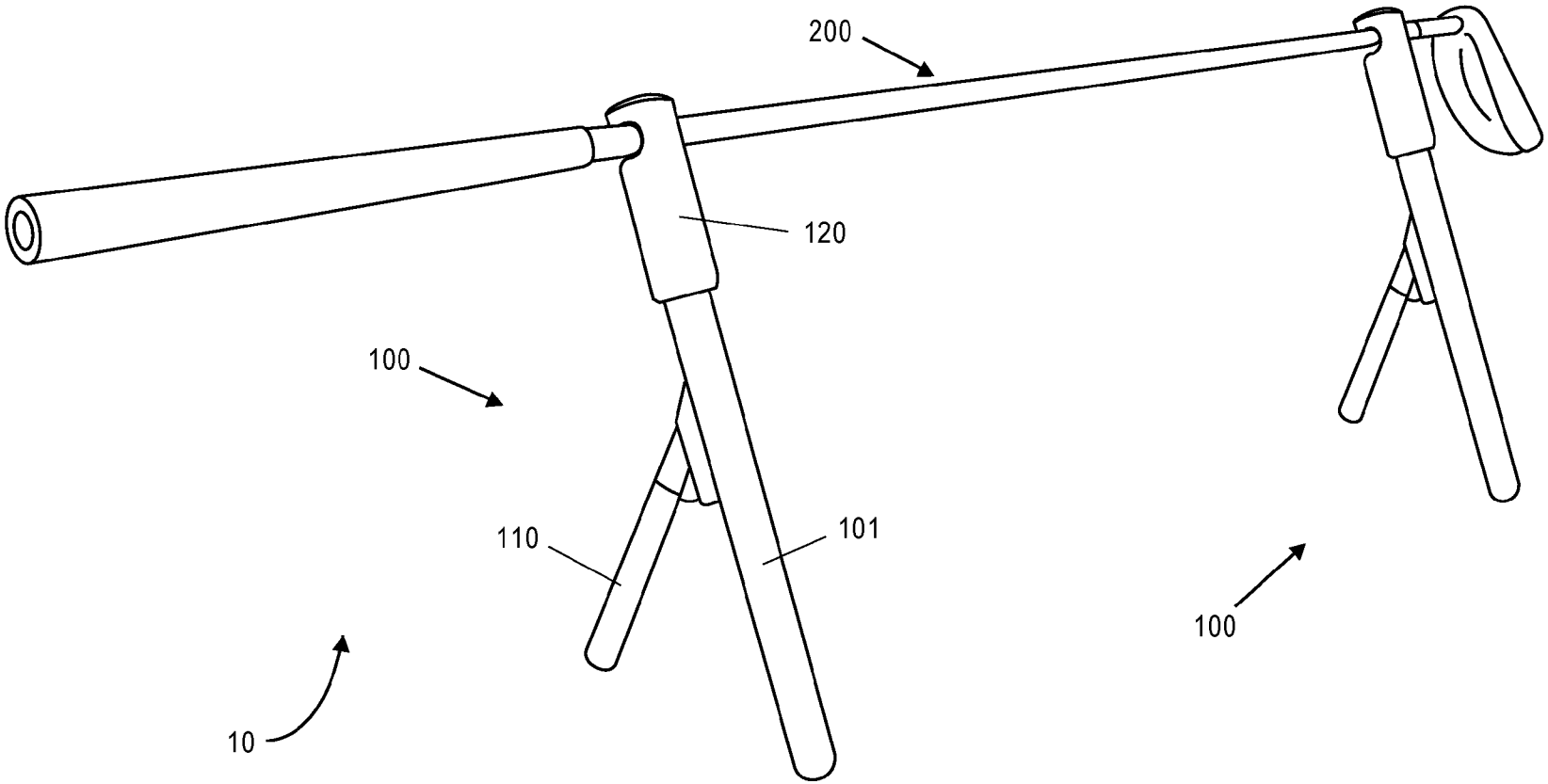
FIG. 1 is a perspective view of a system for golf putting practice in accordance with the example embodiments.

FIG. 1 is a perspective view of a system for golf putting practice in accordance with the example embodiments. System 10 includes an elongate, straight shaft 200 supported horizontally above a ground surface by a pair of shaft support devices 100 in spaced relation to one another and connected to the shaft 200 at a movable top slider 120. Each shaft support device 100 includes a main support 101 and a pivotable angled leg 110. The angled leg 110 is biased under spring action, as to be described in further detail hereafter.

Figure 2:
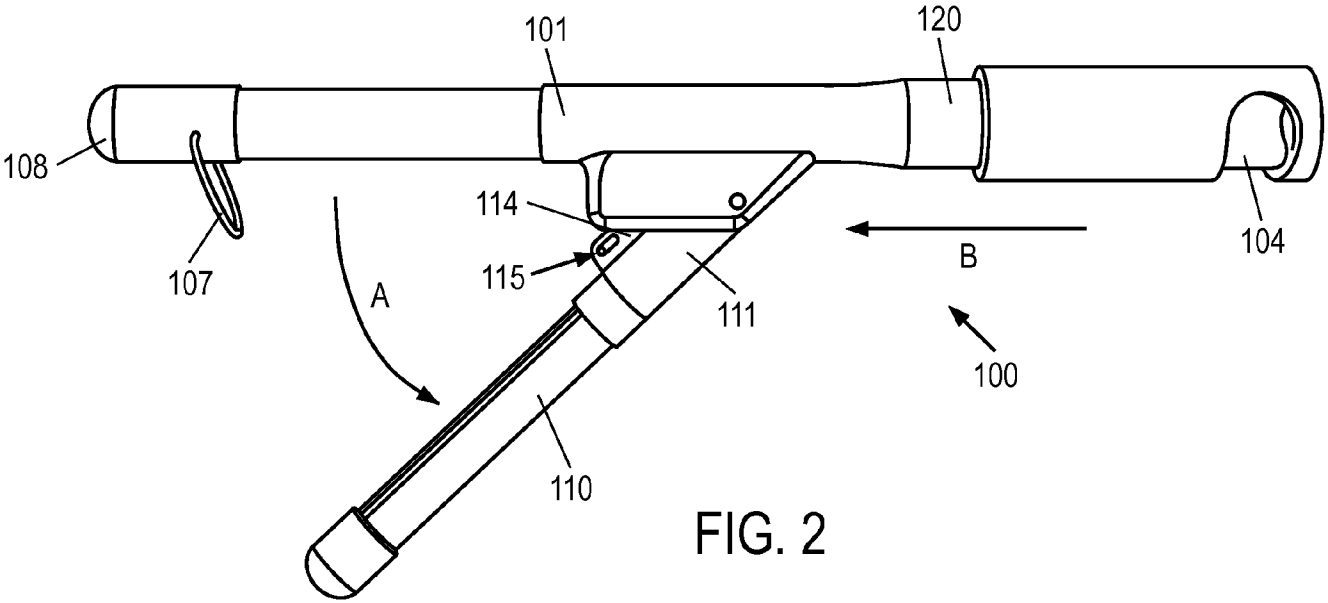
FIG. 2 is a left-side view of a shaft support device in a secured state, according to an example embodiment.
Figure 3:
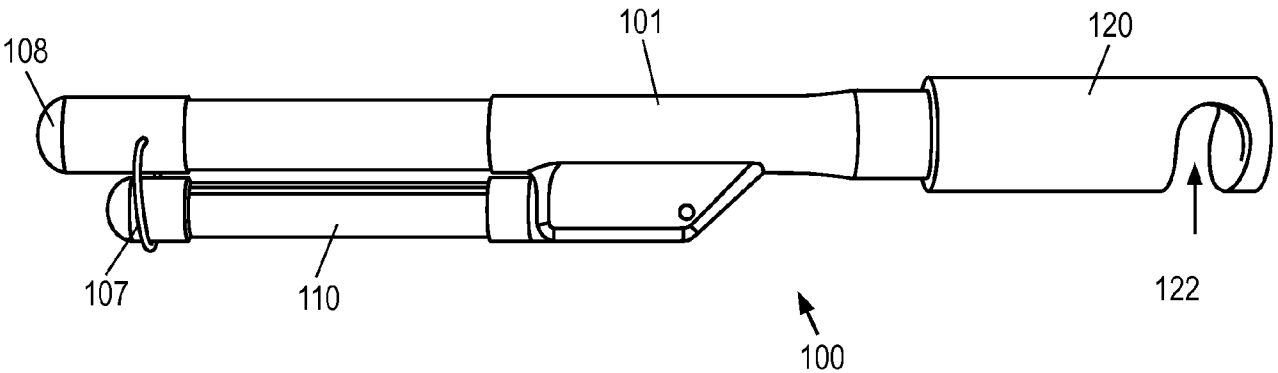
FIG. 3 is a left-side view of the shaft support device in an unsecured state.

FIG. 2 is a left-side view of a shaft support device in a secured state, according to an example embodiment; and FIG. 3 is a left-side view of the shaft support device in an unsecured state. As can be seen in the secured state of FIG. 2, in the secured state the angled leg 110 is pinned to the main support 101 by a loop hook 107. Loop hook 107 is needed as the angled leg 110 is biased under spring pressure (a spring is contained within main support 101, as described in more detail hereafter). In the secured state (or if a user grasps/presses the angled leg 110 against the main support 101), this internal spring is stretched, causing an internal piston to move top slider 120 up relative to the main support 101 so as to create the opening 122 that is to receive shaft 200; this can be seen in FIG. 2.

Conversely, by releasing the loop hook 107, shaft support device 100 shifts to an unsecured state; the angled leg 110 is forced out by spring pressure (see arrow A). This action compresses the internal spring and thus lowers the top slider 120 relative to main support 101 (see arrow B) to close down on opening 122, in which an upper portion of main support 101, termed a slotted upper portion 104, will seat against whatever is in opening 122 (such as shaft 200). This will be explained in further detail below.

As best seen in FIG. 2, the angled leg 110 is shorter than the main support 101 of the shaft support device 100. This is purposefully designed for, since as the shaft support device 100 is opened in the unsecured state (see FIG. 3) and assembled on shaft 200, the shorter leg 110 causes the device 100 to "lean" forward slightly, as best seen in FIG. 1. The leaning allows the golfer's putter to move along the shaft 200 without the heel of the putter hitting either of the attached devices 100. The upper end of angled leg 110 terminates in a flange part 111. Flange part 111 includes a tab 114 thereon which has slotted pin mechanism 115 to hold one end of a link (not shown). This shall be described in more detail hereafter.

Figure 5:
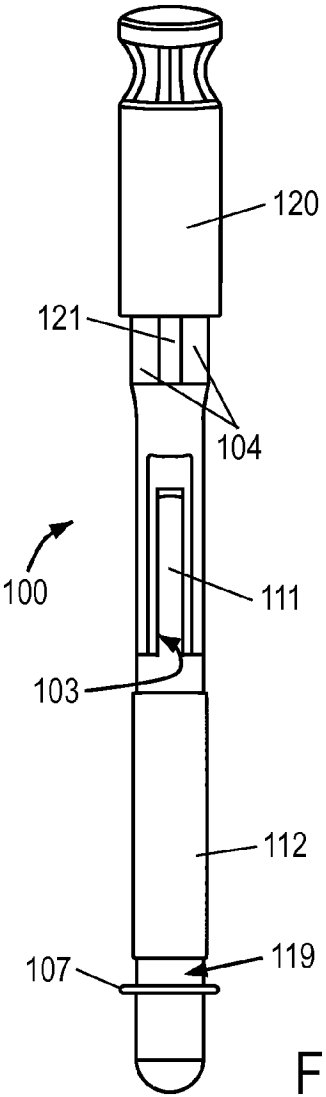
FIG. 5 is a front plan view of the shaft support device.
Figure 4:
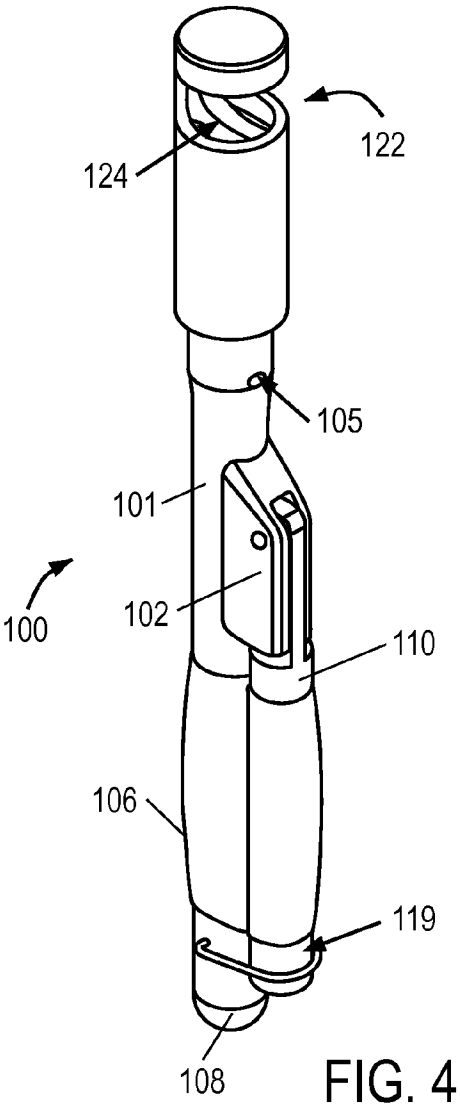
FIG. 4 is a top perspective view of the shaft support device.
Figure 6:
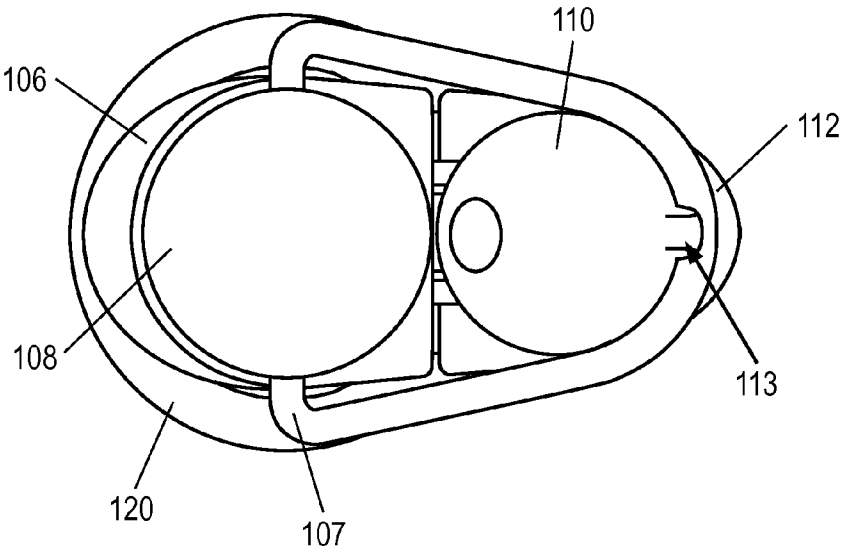
FIG. 6 is a bottom plan view of the shaft support device.

FIG. 4 is a top perspective view of the shaft support device: FIG. 5 a front plan view; FIG. 6 a bottom plan view; and FIG. 7 a left-side elevational view of the shaft support device. Referring to FIGS. 4 through 7, the top of the main support 101 terminates in the slotted upper portion 104 which has a central recess. The top slider 120 has a central ridge portion 124 which fits in a slot 105. A lower portion of the top slider 120 is formed in the shape of an internal piston 121 (not shown) within the main support 101. The top slider 120 with piston 121 moves as one up and down relative to the main support 101. The main support 101, angled leg 110 and top slider may be formed from a hard plastic such as ABS or other synthetic material such as a tralc-filled polypropolyene, for example.

The main support 101 includes a bumpout 102 which has a recess 103 for receiving the flange part 111 of the angled leg 110, each of the flange part 111 and bumpout 102 having alignment holes and are connected by fastening means such as a simple roll pin to facilitate pivotable movement of the angled leg 110 at the junction.

As shown in FIGS. 4 and 5, the lower end of angled leg 110 includes an angled hole 119. Some golfers may desire to make the assembled system 10 more stable. Accordingly, each shaft support device 100 includes a hole in each angled leg 110 through which a golfer may insert a golf tee there through (once the device 100 is secured onto the shaft) into a practice green or ground to add additional stability to the system 10.

Figure 7:
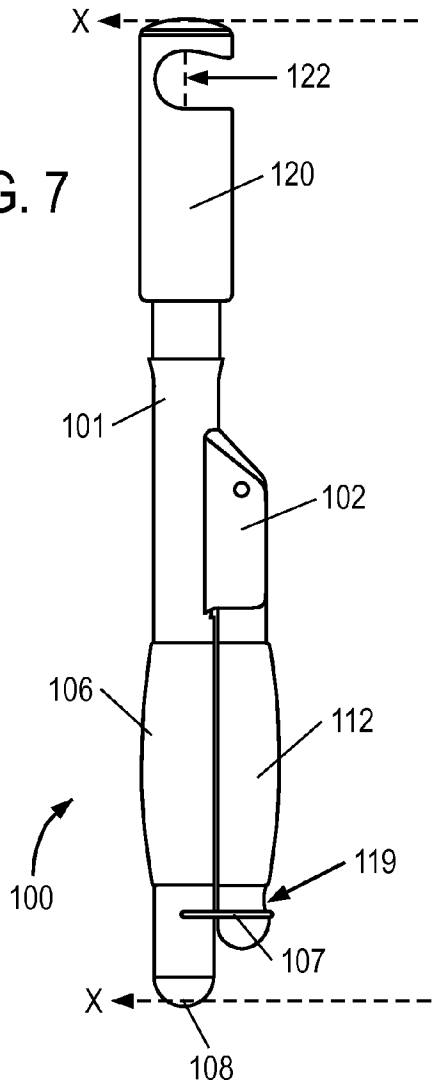
FIG. 7 is a left-side elevational view of the shaft support device.

As best seen in FIG. 6, the bottom of the main support 101 terminates in an end cap 108. The bottom of the angled leg 110 has a hook catch 113 formed therein to secure the hook loop 107 thereon to place the shaft support device in a secured state. As best seen in FIG. 7, each of the main support 101 and angled leg 110 can include a rubberized or elastomeric overmold grip 106 and 112 for ergonomics, for example.

Figure 8:
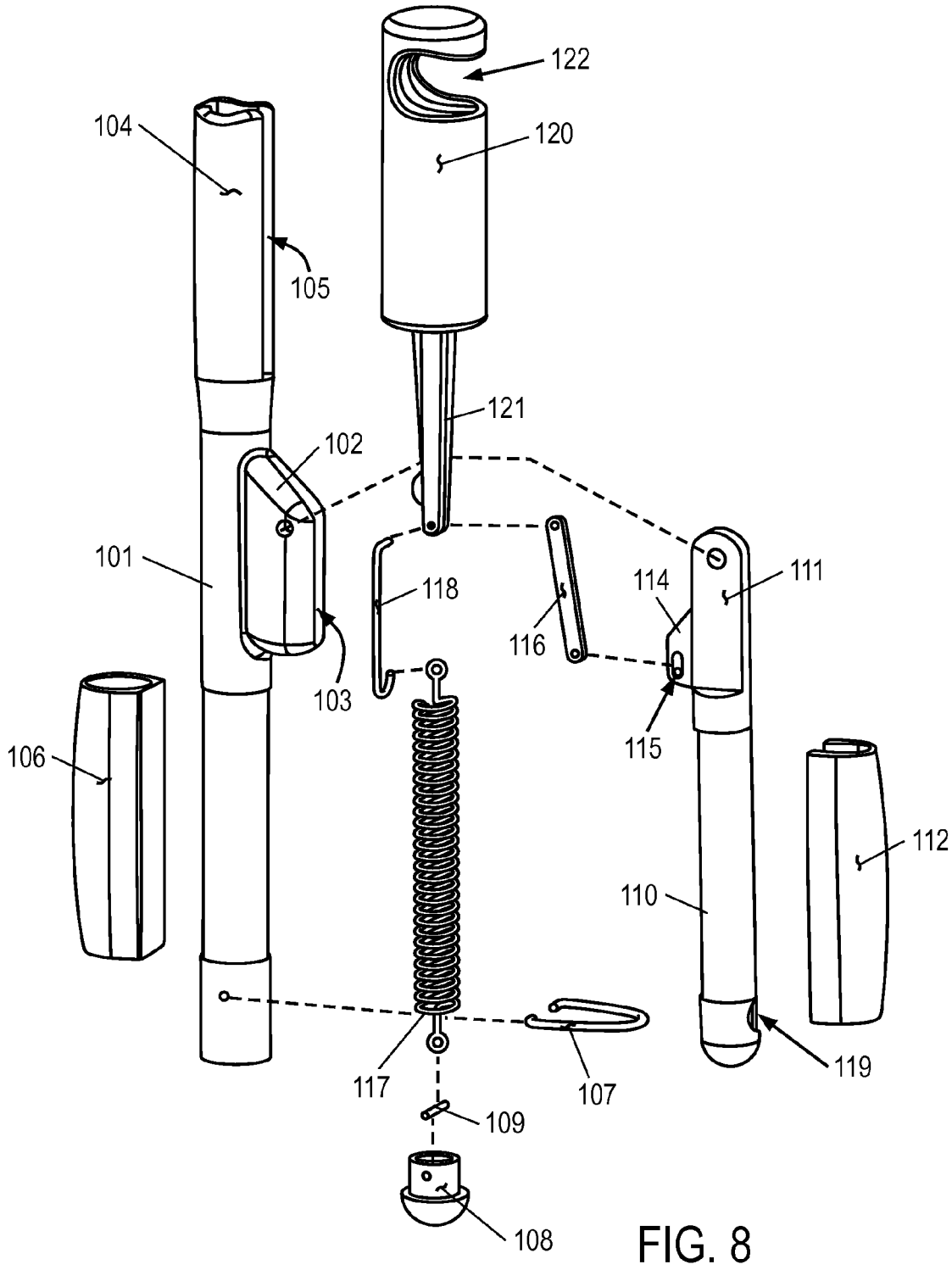
FIG. 8 is an exploded view of the shaft support device to illustrate selected interior components thereof.

FIG. 8 is an exploded view of the shaft support device to illustrate selected interior components thereof. Dotted lines are provided in an attempt to show the connective relationships between components in FIG. 8. Referring to FIG. 8, an internal extension spring 117 is housed within the main support 101. In an example, spring 117 may be a wire wound extension spring. The lower end of spring 117 is connected via pin 109 to end cap 108. The upper end of spring 117 is secured to a lower end of a spring mount ring 118. The upper end of spring mount ring 118 extends through a hole in an upper end of a link 116 and into a hole provided at the bottom of the internal slider piston 121, which is an integral part of top slider 120. The flange part 111 of angled leg 110 includes a tab 114. Tab 114 includes a pin mechanism 115 to which is secured a lower end of link 116.

Figure 9B:
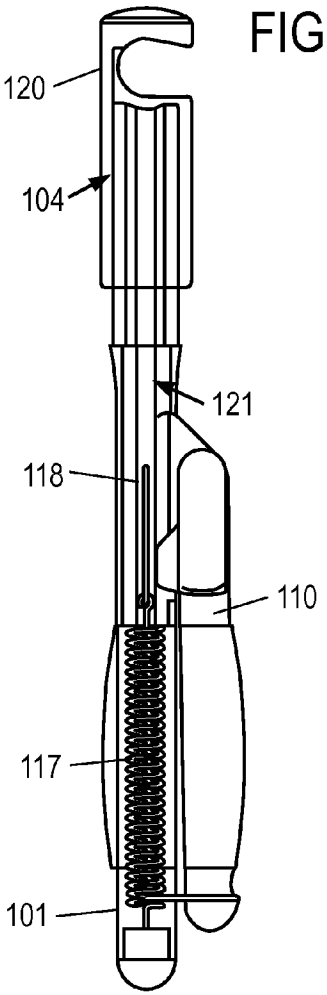
FIG. 9B is a left-side elevational view with several components shown in transparent so as to see inner structural component inter-workings in a secured configuration.
Figure 9A:
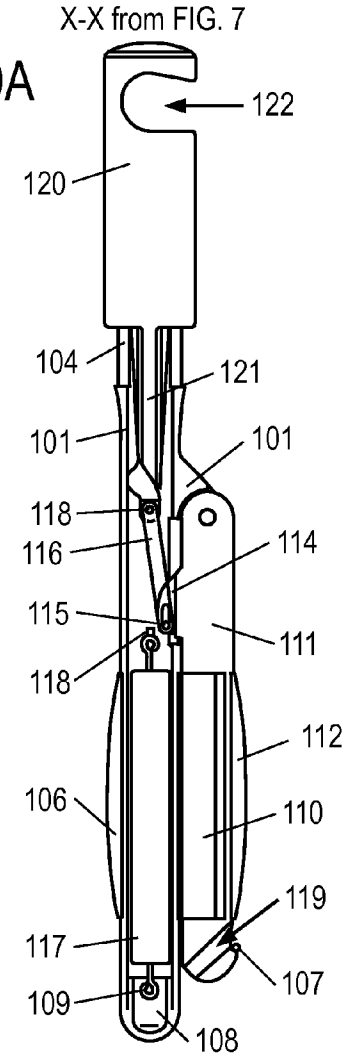
FIG. 9A is a cross-sectional view taken from X-X of FIG. 7 to illustrate selected interior components of the shaft support device.

FIG. 9A is a cross-sectional view taken from X-X of FIG. 7 to illustrate selected interior components of the shaft support device; FIG. 9B is a left-side elevational view with several components shown in transparent so as to see inner structural component inter-workings in a secured configuration; and FIG. 9C is a left-side elevational view with several components shown in transparent so as to see inner structural component inter-workings in an unsecured configuration.

Figure 9C:
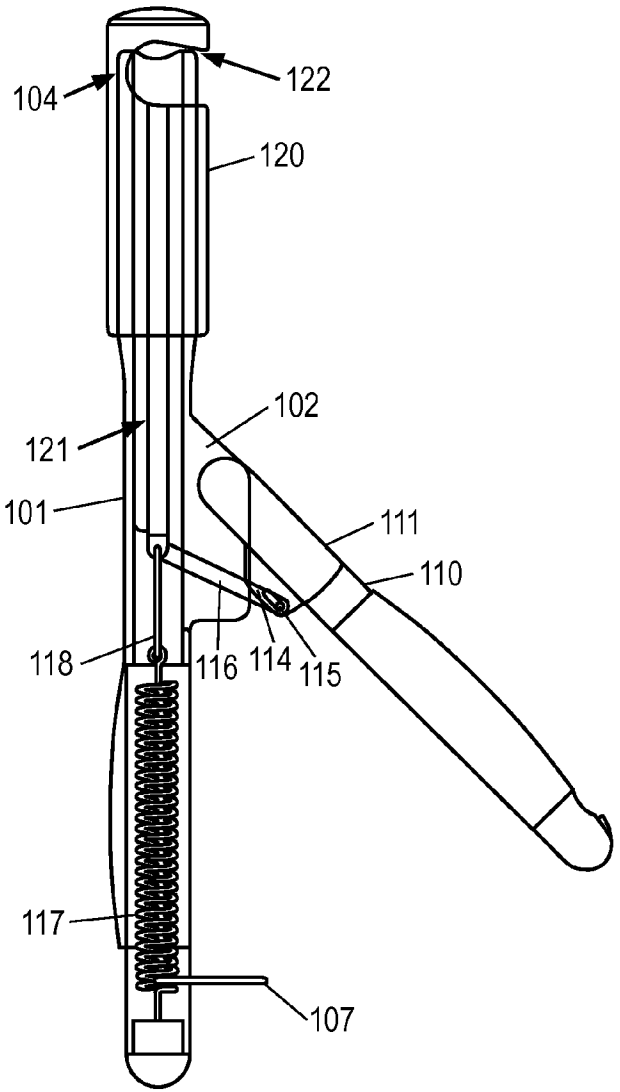
FIG. 9C is a left-side elevational view with several components shown in transparent so as to see inner structural component inter-workings in an unsecured configuration.

Referring to FIGS. 9A to 9C, the bottom of internal piston 121 and top of link 116 are connected to the top of the spring mount ring 118 (ring 118 shown only in face-on view in this X-Y plane cross section in FIG. 9A); the spring 117 is shown connected to the lower end of mount ring 118, and lower part of link 116 is connected to the tab 114 of flange part 111 at pin 115. As best seen in FIG. 9B, in the secured configuration, the spring 117 is expanded, pushing up mount ring 118 and hence causing upward movement of the internal piston 121 and hence causing the top slider 120 to be elevated relative to the slotted upper portion 104 of the main support 101, thereby creating the opening 122 as shown in FIG. 2 for example. This action can be pronounced by a user grabbing the two grips 106/112 and pressing them together to force the angled leg 110 against the main support 101.

As best shown in FIG. 9C, by releasing the hook loop 107, the angled leg rotates out under spring bias, compressing, the spring via link 116 and mount ring 118. Spring 117 compresses, this pulls down the mount ring, lowering the piston 121 and hence top slider 120 relative to the slotted upper portion 104 of the main support 101. This thus closes down on opening 122, as can be seen in FIG. 9C.

Figure 10:
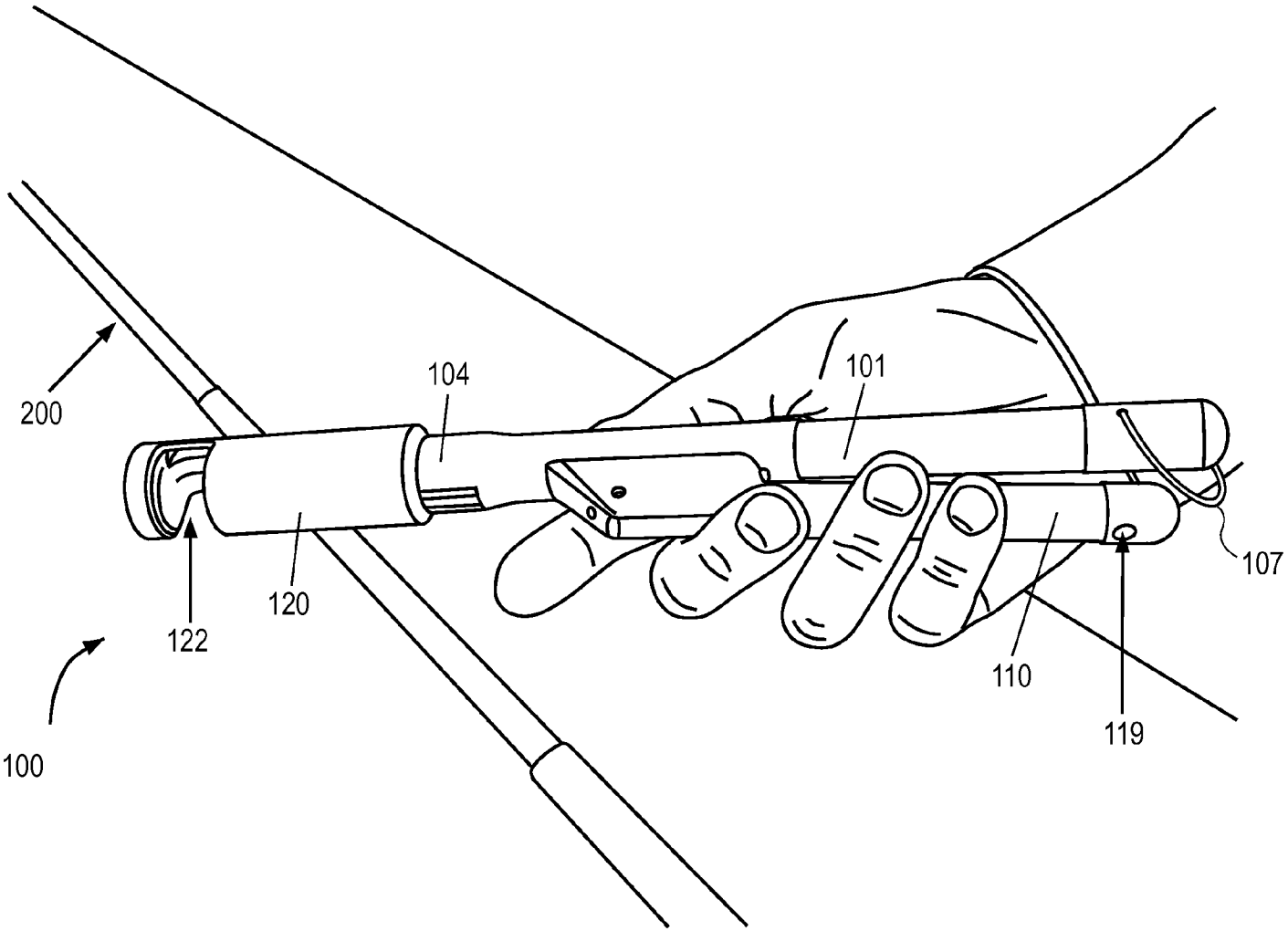
FIG. 10 illustrates a user squeezing the angled leg toward the main support to re-position the slider body.
Figure 11:
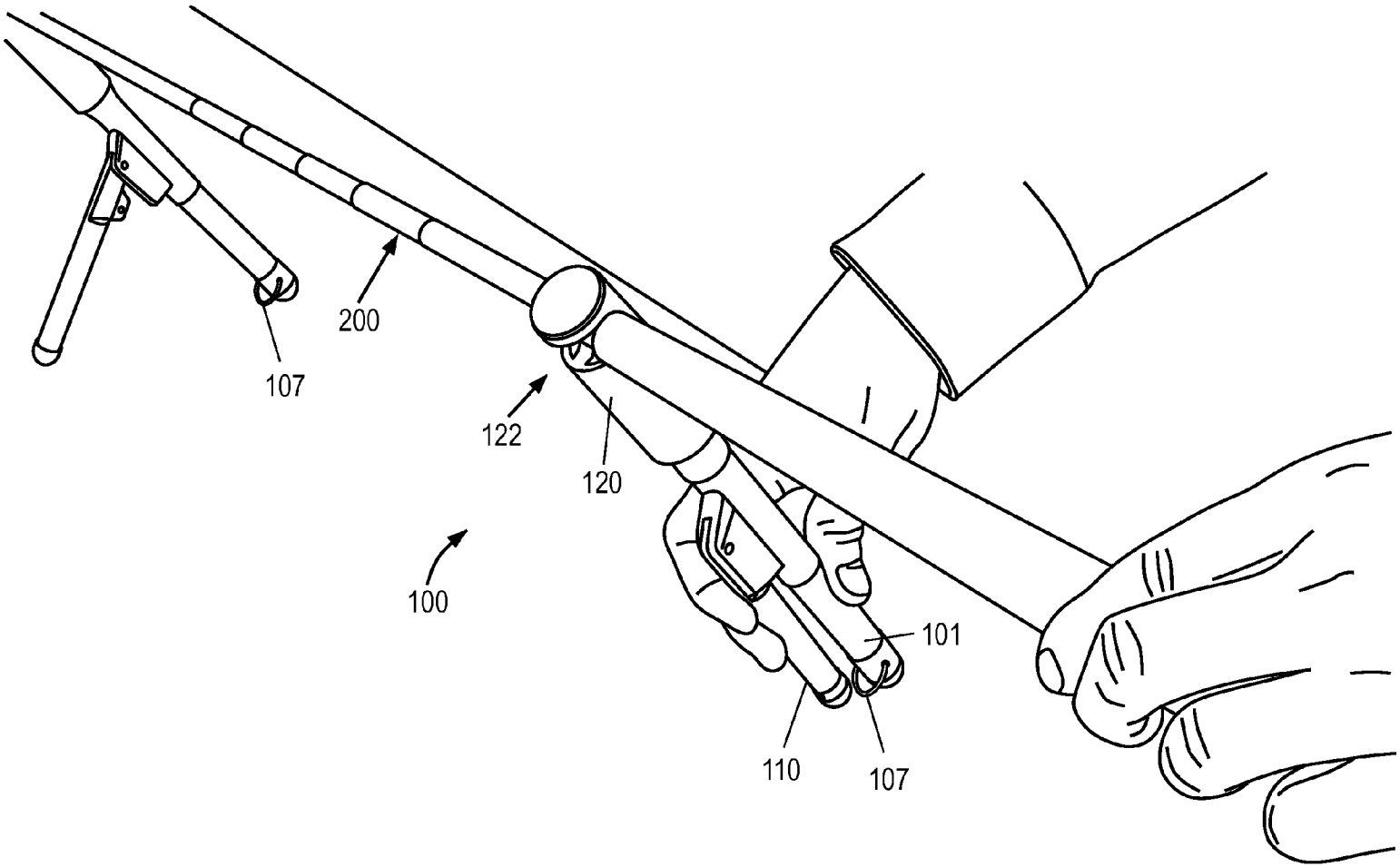
FIG. 11 illustrates the user placing the shaft support device on a shaft.
Figure 12:
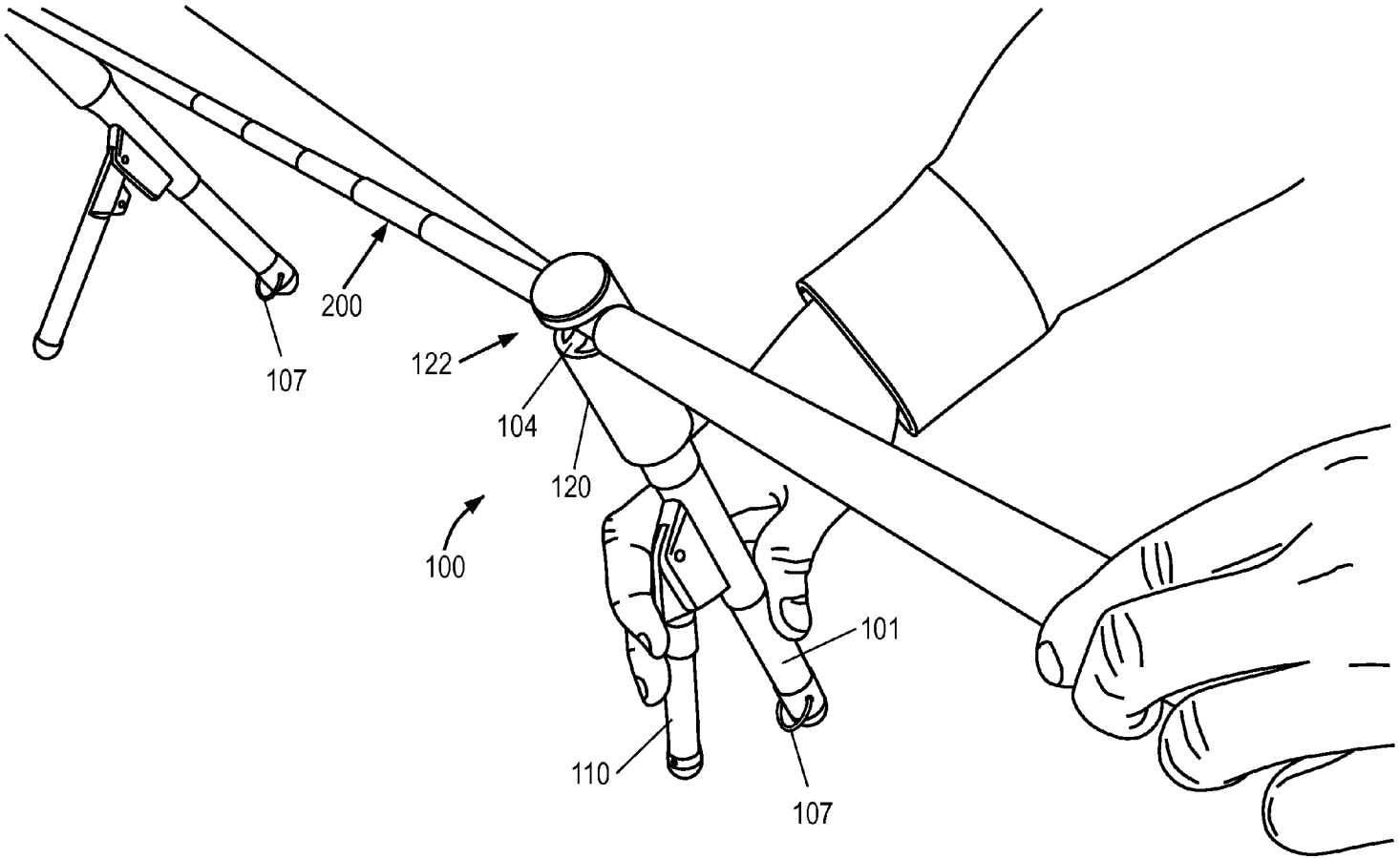
FIG. 12 illustrates the user releasing the angled leg to secure the shaft support device to the shaft.

The following FIGS. 10-12 are described for illustrating a process of assembling the system for use in putting practice.

FIG. 10 illustrates a user squeezing the angled leg toward the main support to re-position the slider body. In one example, the golfer would initially take his/her driver (or another club or another shaft such as an alignment stick) from their bag. They would then unhook the angled leg 110 by flipping the loop hook 107 off the hook catch 113 on one of the shaft support devices 100. That angled leg 110, a shorter leg, is spring-loaded and will move outward several inches.

As shown in FIG. 10, the golfer will then grip the angled leg 110 and the main support 101, much like one would hold a pair of pliers. The golfer would squeeze the angled leg toward the main support 101, stretching the internal spring 117 and causing the internal piston 121 to move down, causing top slider 120 to move up relative to the upper slotted portion 104 of the main support 101. This creates the opening 122 that permits the shaft 200 to be introduced therein.

FIG. 11 illustrates the user placing the shaft support device on a shaft. As shown, with the user still gripping the shaft support device 100, the device 100 is placed over the shaft 200 such that the shaft 200 is inserted into opening 122. The device 100 can be slid along shaft 200 to any desired position on the shaft 200.

FIG. 12 illustrates the user releasing the angled leg to secure the shaft support device to the shaft. When the angled leg 110 is released, the internal spring compression will pull the internal piston 121 against the shaft 200 now captured in the opening 122 of the top slider 120. In other words, the top slider 120 will move downward relative to the main support 101, causing the upper slotted portion 104 to seat against the shaft 200 within opening 122. The spread between angled leg 110 and main support 101 will provided support for the shaft 200 above device 100.

The second shaft support device 100 is installed as above in spaced relation from the first along the shaft 200, providing a horizontal guide line for putting practice. As previously noted, the shorter angled legs 110 of the installed devices 100 provides a system 10 in which each device 100 leans forward slightly, as best seen in FIG. 1. This allows the golfer's putter to move along the shaft 200 without the heel of the putter contacting either of the attached devices 100 during a practice stroke.

Figure 13:
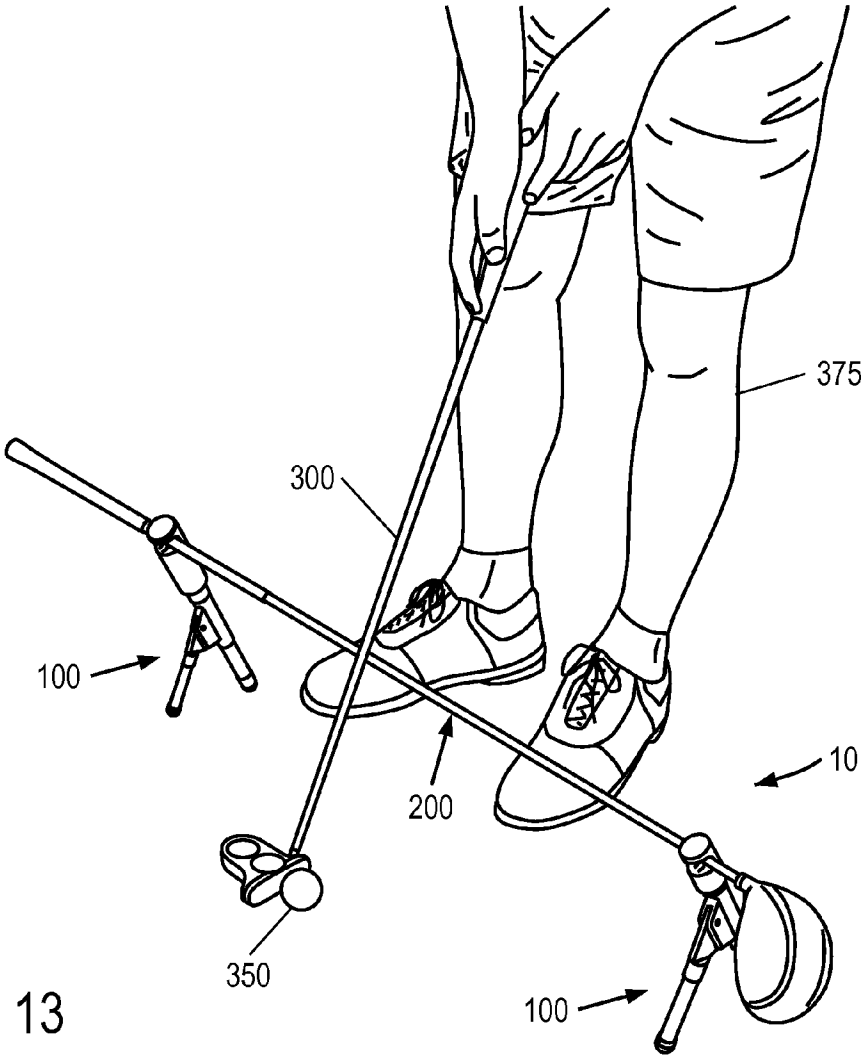
FIG. 13 illustrates the system in place with a putter arranged in position to practice a putt along the straight shaft guide line provided by the shaft support devices of the system.

FIG. 13 illustrates the system in place with a putter arranged in position to practice a putt along the straight shaft guide line provided by the shaft support devices of the system. As shown in FIG. 13, system 10 is shown assembled, with a pair of shaft support devices 100 are shown in spaced relation supporting a shaft 200, here a driver 200, so as to achieve the level horizontal position of the shaft 200 above the ground to serve as a guide for a golfer 375 practicing putting strokes of a golf ball 350 with a golf putter 300. By keeping the shaft of putter 300 in light contact with the guide (shaft 200) during a practice putting stroke, the golfer 375 may achieve a natural perfect pendulum.

Accordingly, the system and device as described in the example embodiments may permit any golfer of any size and degree/angle at address to putt on a perfect pendulum. If the pendulum is perfectly vertical, it would be straight back and straight through. Any degree or angle other than vertical will create a natural and perfect "arc."

Thus, the example system and device guides the shaft of the putter along a straight line to create a perfect pendulum golf putting swing with either a straight back and through or arc depending upon the angle/degree of the putter at address to create a consistent and natural putting stoke to come into contact with a golf ball. The system and device is portable; the devices are carried in the golf bag when not in use, and employ existing club shafts or alignment line up sticks (collectively defined herein as a shaft) which are already in the bag to provide a guide for the system. As previously discussed, one example for the guide or straight shaft may be the driver; the longest club in the bag. Additionally, a common golf line up stick that is a long and perfectly cylindrical shaft may be used. As long as the golfer keeps his/her putter shaft in light contact with the horizontal shaft resting in the two shaft support devices, the putting motion is a perfect pendulum. A pendulum is straight back and straight through but depending on how many degrees of tilt there is in the pendulum from vertical, it naturally creates what can be considered the perfect "arc" when it comes to a putting stroke.

In contrast to existing putting training aids and/or line up sticks the example system allows any golfer of any size to address the ball with varying pendulum angle to assimilate the correct path that fits him/her. As previously noted, most other popular putting training aides come in contact with the heel of the putter in a "one size training aide arc fits all" scenario.

The example embodiments being thus described, it will be obvious that the same may be varied in many ways. Such variations are not to be regarded as departure from the example embodiments, and all such modifications as would be obvious to one skilled in the art are intended to be included herein.

What is claimed:

1. A system for golf putting practice, comprising:

an elongate, straight shaft, and a pair of shaft support devices configured for attachment to the shaft in spaced relation so as to hold the shaft in a level horizontal position above the ground, each shaft support device including:

an elongate main support having an upper end and lower end, a top slider slidably attached to the upper end, the top slider having a crescent-shaped opening on a top, side surface that is configured to grasp the shaft, an elongate angled leg shorter relative to the main support and having its upper end attached to an approximate midpoint of the main support, the angled leg pivotable at its attachment point to the main support and biased under spring pressure, and a loop hook for securing the angled leg alongside the main support, wherein the loop hook is unhooked and the angled leg is released and squeezed against the main support to expose the crescent-shaped opening to attach the shaft support device to the shaft, the angled leg then released to pivot outward under spring action, causing the top slider to move down relative to the upper end of the main support, the main support upper end seating against the shaft, the spaced-apart lower ends of the angled leg and main support forming legs of the shaft support device.

2. The system of claim 1, wherein with the shaft support devices in spaced relation on the shaft to achieve the level horizontal position of the shaft, the shaft becomes a guide for a golfer practicing putting strokes with a golf putter, and as long as the golfer maintains the putter shaft in light contact with the horizontal shaft resting on the two support devices, the putting motion is a perfect pendulum.

3. The system of claim 1, further comprising overmold grip portions covering part of the main support and angled leg.

4. The system of claim 1, wherein the main support includes a bumpout having a central recess, the angled leg's upper end terminated in a flange part configured to seat in the recess, and each of the bumpout and recess have alignment holes secured by a fastener that serves as an attachment point of the angled leg to main support, enabling pivotable movement of the angled leg to and from the main support.

5. The system of claim 4, wherein the main support is hollow, the main support including an end cap at the lower end thereof, an internal spring provided within the main support, the spring having a lower end attached within the end cap, the top slider lower end terminating in an elongate internal piston connected to the spring upper end, and a link provided within the main support and having its upper end connected to the piston lower end and attached to the spring upper end, the link lower end attached to the angled leg so that the angled leg pops open under action of the spring unless held to the main support or secured by the loop hook, wherein squeezing the angled leg to the main support expands the spring upward to push up the piston so as to raise the top slider relative to the main support to expose the opening, and releasing the angled leg causes the spring to compress the spring to force the angled leg outward, pulling the piston down to lower the top slider relative to the main support to shut down the opening in the top slider.

6. The system of claim 1, wherein in a closed configuration, the angled leg is shorter than the main support, so that in an opened configuration when the pair of shaft support devices has been installed in spaced relation on the shaft, the shorter legs cause the devices to lean forward, permitting and allowing a golfer's putter to move along the shaft without a heel of the putter hitting either of the attached devices.

7. The system of claim 1, wherein lower ends of the angled legs includes a hole configured to receive a golf tee there through to secure the shaft support devices to a putting green or ground surface, when the legs are spread apart so the devices are configured to support the shaft thereon.

8. A support device configured for attachment to a golf club shaft to hold the shaft in a level horizontal position above the ground for use as a guide in putting practice, comprising:

a first leg having an upper end and lower end, a slider element slidably attached to the upper end and configured to grasp the shaft, a second leg shorter relative to the first leg and having its upper end attached to an approximate midpoint of the first leg, the second leg pivotable at its attachment point to the first leg and biased under spring pressure, and a loop hook for securing the second leg alongside the first leg, wherein the loop hook is unhooked and the second leg is released and squeezed against the first leg to expose an opening in the slider element configured to receive the shaft therein, the second leg then released to pivot outward under spring action, causing slider element to move down relative to the upper end of the first leg, closing down on the opening and seating the shaft within the opening against the first leg upper end, and a second support device is installed in spaced relation on the shaft to achieve the level horizontal position of the shaft as a guide for a golfer practicing putting strokes with a golf putter.

9. The device of claim 8, wherein as long as the golfer maintains the putter shaft in light contact with the horizontal shaft resting on the two support devices, the putting motion is a perfect pendulum.

10. The device of claim 8, further comprising overmold grip portions covering part of the first and second legs.

11. The device of claim 8, wherein the first leg is hollow and includes:

an end cap at the lower end thereof, an internal spring within, the spring having a lower end attached within the end cap, an elongate internal piston within that forms a lower part of the slider element and having its lower end attached to the spring upper end, and a link within, the link having its upper end connected to the piston lower end and attached to the spring upper end, the link lower end attached to the second leg so that the second leg pops open under action of the spring unless held to the first leg or secured by the loop hook.

12. The device of claim 11, wherein squeezing the second leg to the first leg expands the spring upward to push up the piston so as to raise the slider element relative to the first leg to expose the opening, and releasing the second leg causes the spring to compress to spring to force the second leg to pivot outward, pulling the piston down to lower the slider element relative to the first leg to shut down the opening in the slider element.

13. The device of claim 8, wherein in a closed configuration, the second leg is shorter than the first leg, so that in an opened configuration when the two support devices are installed in spaced relation on the shaft, the shorter legs cause the devices to lean forward, permitting the putter to move along the shaft without a heel of the putter hitting either of the attached devices.

14. The device of claim 8, wherein the lower end of the second leg includes a hole configured to receive a golf tee there through to secure the device to a putting green or ground surface.

15. A pair of devices configured for attachment to a shaft to hold the shaft in a level horizontal position above the ground for use as a guide in putting practice, each device of the pair comprising:

a first leg, a slider element attached to the first leg for grasping the shaft, a shorter second leg pivotable to and from the first leg, wherein the second leg is squeezed against the first to expose an opening in the slider element to receive the shaft therein, the second leg then released to pivot outward, causing the slider element to move down relative to an upper end of the first leg, closing down on the opening and seating the shaft, each device installed in spaced relation on the shaft to achieve the level horizontal position of the shaft as a guide for a golfer practicing putting strokes with a golf putter.

* * * * *